United States Patent [19]

Yoshikawa et al.

[11] 4,408,697

[45] Oct. 11, 1983

[54] OPENING MEANS HAVING CUTTING GUIDE

[75] Inventors: Tsukasa Yoshikawa, Inagi; Masuo Kitamura, Ohmiya, both of Japan

[73] Assignee: Tokan Kogyo Co., Ltd., Tokyo, Japan

[21] Appl. No.: 387,438

[22] Filed: Jun. 11, 1982

[30] Foreign Application Priority Data

Jun. 20, 1981 [JP] Japan ..... 56-95609

[51] Int. Cl.[3] ..... B65D 17/46

[52] U.S. Cl. ..... 220/279; 220/267; 220/270

[58] Field of Search ..... 220/267, 279, 260, 270

[56] References Cited

U.S. PATENT DOCUMENTS 2,149,308 3/1939 Peckham ..... 220/279

4,301,939 11/1981 Pupp ..... 220/279

*Primary Examiner*—George T. Hall

*Attorney, Agent, or Firm*—McDougall, Hersh & Scott

[57] ABSTRACT

A container for holding an article such as food comprises a container main body and a lid. The lid has a laminate structure of an aluminum foil layer exposed upon an outer surface of the lid and a synthetic resin film layer exposed upon an inner surface of the lid. Cutting means is provided for cutting at least part of the lid. The cutting means comprises a pull-tab arranged on the outer surface of the lid, a cutting guide arranged on the inner surface of the lid along at least an outer periphery of a cutting region, and a connecting portion extending through a small hole formed in said lid so as to connect said pull-tab with said cutting guide. The cutting means comprises molded bodies of a synthetic resin which can not be bonded to the aluminum foil layer and which can be bonded to the synthetic resin film layer upon molding process.

9 Claims, 22 Drawing Figures

OPENING MEANS HAVING CUTTING GUIDE

BACKGROUND OF THE INVENTION

1. Field of the Invention

The present invention relates to a container for holding an article such as food and, more particularly, to a container which is easy to open.

2. Description of the Prior Art

Metal cans with pull-tabs are preferred for use in automatic vending machines of soft drinks or the like. This is because metal cans are easy to open and allow retort sterilization. However, a metal can with a pull-tab requires more parts than a simple metal can, such as a pull-tab and a rivet for mounting it. Furthermore, a notch-shaped or thin cutting guide must be formed to allow opening of a lid along a predetermined shape upon pulling the tab. Metal cans are heavy in weight and are inconvenient to transport. There is also the problem of where to discard the empty cans.

For these reasons, paper or synthetic resin containers for holding soft drinks or food have been proposed. These containers are light in weight, easy to transport, and allow easy disposal after use. It is proposed to mount a pull-tab for a container of this type as in the case of a metal can. However, at least that part of the lid which is to be opened when the pull-tab is pulled must be made of a synthetic resin material, and this results in poor gas barrier properties. Paper containers cannot be subjected to retort sterilization.

Another container has also been proposed which is prepared by forming a hermetically-sealed and heat-resistant container element from a laminate of synthetic resin films, a synthetic resin film and a paper sheet, a synthetic resin film and an aluminum foil layer, a paper sheet and an aluminum foil layer, and so on; filling the container element with desired contents; and sealing the opening of the container element with a lid consisting of an aluminum foil layer or the like.

The container of this type requires the use of a knife or the like to cut the lid in order to open it. In order to solve this problem, it has also been proposed to form a hole in the lid in advance and to seal a piece of an aluminum foil tape with a pull-tab to this hole. However, with this container, the cut portion tends to form irregular sharp edges and may thus hurt lips or hands of the user.

SUMMARY OF THE INVENTION

It is an object of the present invention to provide a container in which an opening may be formed easily and smoothly in a lid along a cutting region of a predetermined shape when a pull-tab is pulled.

It is another object of the present invention to provide a container which provides satisfactory gas barrier properties in the cutting region of the lid.

It is still another object of the present invention to provide a container which is safe to handle and which may not hurt the user at the cut edge of the cutting region of the lid.

The above and other objects, features and advantages of this invention, will be apparent from the following detailed description of illustrative embodiments which are to be read in connection with the accompanying drawings.

DETAILED DESCRIPTION OF THE PREFERRED EMBODIMENTS

Figure 1:
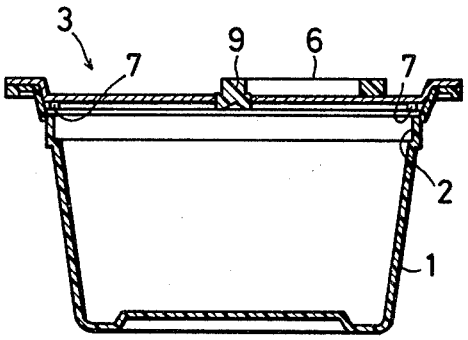
FIG. 1 is a longitudinal sectional view of a container according to an embodiment of the present invention.

FIGS. 1 to 5 show an embodiment of the present invention. A container according to this embodiment is a disposable-type container for holding food. Referring to FIG. 1, this container comprises a cup-shaped container main body 1, and a disc-shaped lid 3 covering an opening 2 at the upper part of the container main body 1. The container main body 1 has a multilayered laminate structure of a number of synthetic resin films and provides a satisfactory hermetic seal or gas barrier properties. The container main body 1 may alternatively comprise a laminate of a synthetic resin film with a paper sheet, or a laminate of a synthetic resin film with an aluminum foil layer. In these cases, the resin film preferably faces outward.

Figure 2:
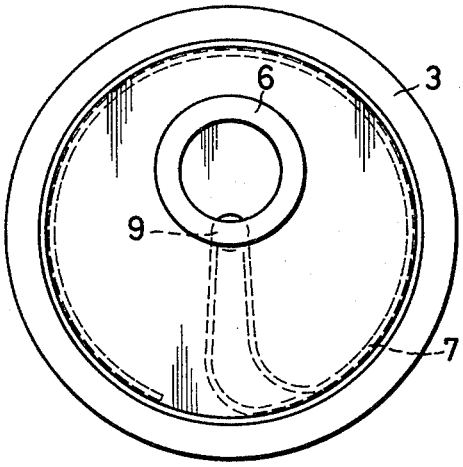
FIG. 2 is a plan view of the container shown in FIG. 1.
Figure 3:
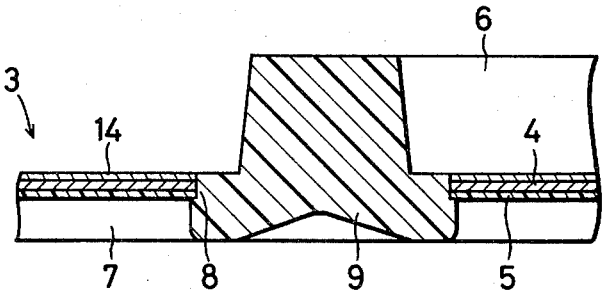
FIG. 3 is an enlarged sectional view of the lid.
Figure 4:
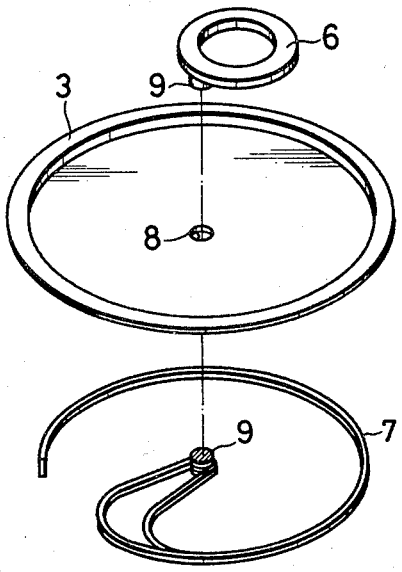
FIG. 4 is an exploded perspective view of the lid.

Referring to FIGS. 2 to 4, the lid 3 is of a bilayered structure consisting of an aluminum foil layer 4 and a resin layer 5. The resin layer 5 is of a multilayered laminate structure consisting of a plurality of synthetic resin films. A rustproof coating 14 is formed over the outer surface of the aluminum foil layer 4. The coating 14 is exposed to the upper side or the outer surface of the lid 3, while the resin layer 5 is exposed to the lower side or the inner surface of the lid 3. The coating 14 need not always be formed.

The lid 3 further has a pull-tab 6 and a cutting guide 7. The cutting guide 7 extends spirally outward from the center of the lid 3. The pull-tab 6 and the cutting guide 7 are connected by a connecting portion 9 extending through a small hole 8 formed substantially at the center of the lid 3. The outer periphery of the lid 3 is heat-sealed to the outer periphery of the container main body 1.

Figure 5:
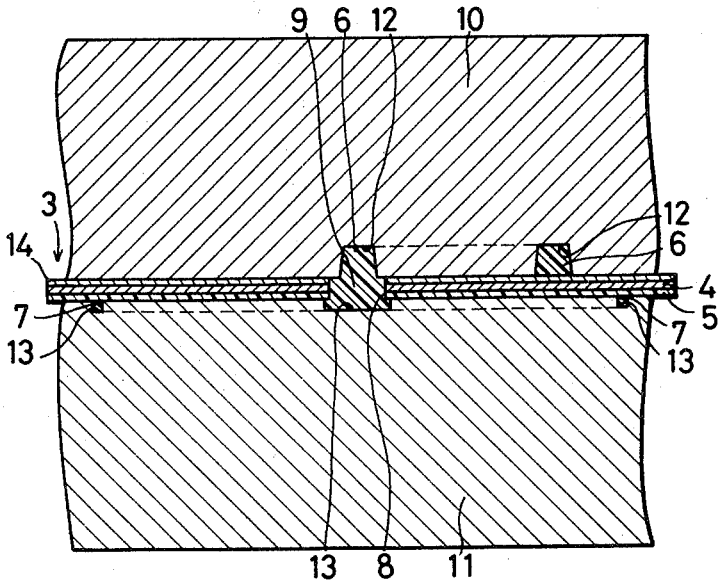
FIG. 5 is a longitudinal sectional view of a mold for forming a pull-tab and a thin cutting guide on the body.

The pull-tab 6 and the cutting guide 7 are formed in the manner as shown in FIG. 5. A sheet for the lid 3 is clamped between a pair of molds 10 and 11. A polyethylene terephthalate resin is injected into cavities 12 and 13 defined by these molds 10 and 11, respectively. The pull-tab 6 is formed on the upper surface of the lid 3 by the cavity 12, while the cutting guide 7 is formed on the lower surface of the lid 3 by the cavity 13. Since the cavities 12 and 13 oppose each other at the area of the small hole 8 of the lid 3, the connecting portion 9 is formed to extend through this small hole 8 to connect the pull-tab 6 with the cutting guide 7.

Since the pull-tab 6 is formed on the coating 14, which is formed on the upper surface of the lid 3 and which is prevented from being joined to the polyethylene terephthalate resin, the pull-tab 6 may not be joined to the lid 3 at places other than the connecting portion 9. Therefore, the pull-tab 6 can be pulled up with a finger and be separated from the surface of the lid 3, so that the user may insert his finger into the ring-shaped pull-tab 6. In contrast to this, since the cutting guide 7 is formed on the resin layer 5 which is formed on the lower surface of the lid 3 and which may be joined to the polyethylene terephthalate resin, the cutting guide 7 is joined with the lid 3 through the resin layer 5. Accordingly, the lid 3 can be opened by means of the cutting guide 7. More specifically, when the pull-tab 6 is pulled upward and the finger is inserted in the pull-tab 6 to further pull it upward as described above, the lid 3 is cut along the cutting guide 7 which is connected to the pull-tab 6 through the connection portion 9. The lid 3 is opened along the cutting guide 7, and the food contents in the container main body 1 may be taken out of the container.

According to a container of the embodiment described above, a lid with the pull-tab 6 can be sealed to a container other than a metal can for example, a plastic containers. Thus providing a container with a pull-tab 6 at low cost. Since the pull-tab 6, the cutting guide 7 and the connecting portion 9 can be formed integrally with the lid 3, the number of parts and/or the number of manufacturing steps may be decreased. The container main body 1 and the lid 3 may be made of any material which can provide satisfactory gas barrier properties. If the diameter of the small hole 8 is made small, and if the connecting portion 9 is formed together with the pull-tab 6 and the cutting guide 7 with a resin of excellent gas barrier properties, for example, a polyethylene terephthalate resin, a container is obtained which can provide an excellent hermetic seal. If the shape of the cutting guide 7 is varied, the shape of the opening to be formed thereby may accordingly be varied. Since the notch or thin part need not be formed in the lid 3, the mechanical strength of the lid and its resistance to impact are improved. Since the container main body 1 is made of a resin and the lid 3 is a laminate of the aluminum foil layer 4 and the resin layer 5, hot-water sterilization or retort sterilization may be performed.

Figure 6:
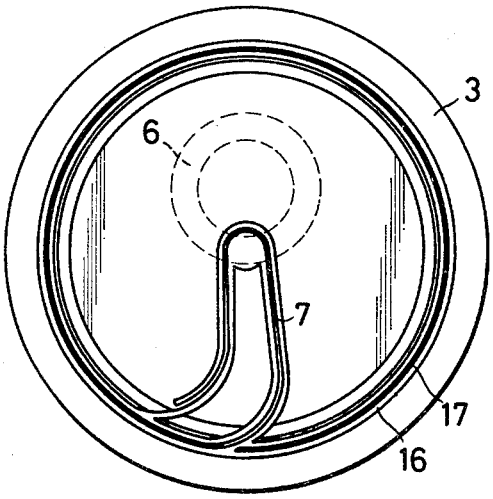
FIGS. 6 to 9 are bottom views of the lid according to modifications of the present invention.

FIG. 6 is a bottom view of the lid 3 according to a modification of the container shown in FIGS. 1 to 4.

According to this modification, a rib 16 is formed around the cutting guide 7 to be integral therewith. Since a narrow groove 17 is defined between the cutting guide 7 and the rib 16, the lid 3 can be easily cut along this groove 17.

Figure 7:
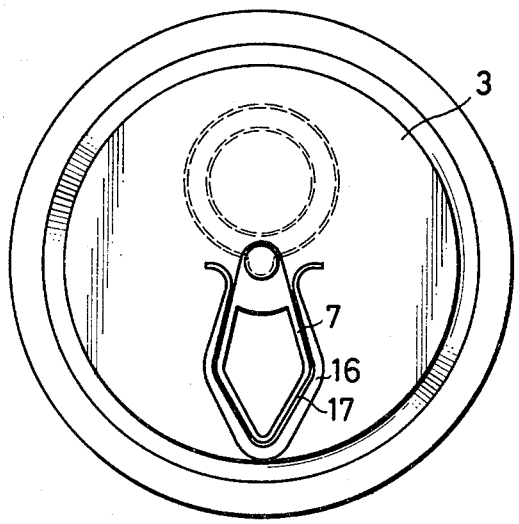
Figure 8:
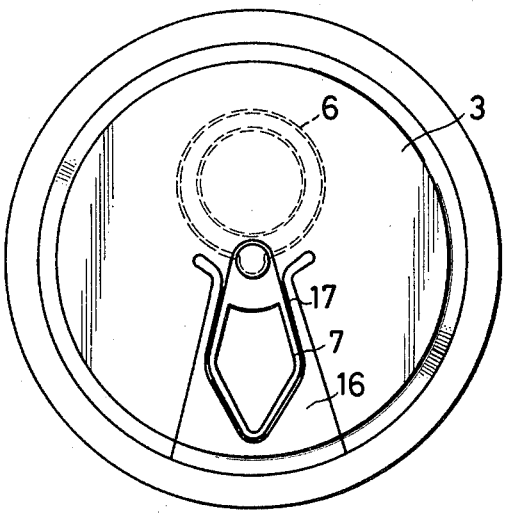
Figure 9:
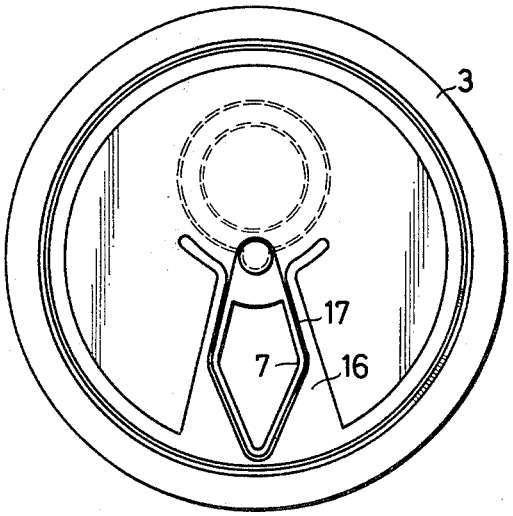
Figure 10:
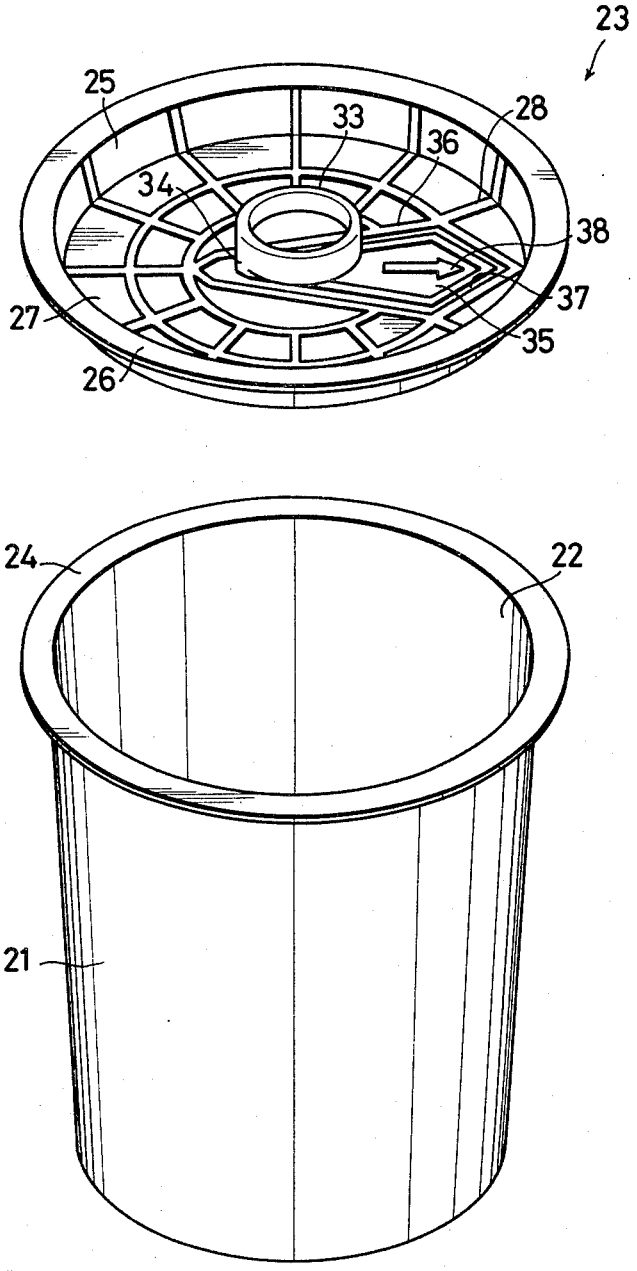
FIG. 10 is an exploded perspective view showing a lid according to another embodiment of the present invention and a container with this lid.

FIGS. 7 to 9 are respectively bottom views of the lid with cutting regions of different shapes according to modifications of the present invention. In these modifications, the cutting guide 7 is formed into a rhombic shape. In the modification shown in FIG. 7, the rib 16 is formed around the cutting guide 7, thus defining the groove 17 therebetween. In the modification shown in FIG. 8, the width of the rib 16 is lengthened towards the periphery of the lid 3, so that the mechanical strength of the part of the lid 3 around the cutting region is reinforced. In the modification shown in FIG. 9, the rib 16 is formed at the cutting region and also extends along the outer periphery of the lid 3.

FIGS. 10 to 16 show another embodiment of the present invention. In this embodiment, a container main body 21 is formed into a cup shape from a laminated paper sheet, a synthetic resin laminate body or any such structure. The container main body 21 has an opening 22 at the top. A flange 24 is formed at the outer periphery of the opening 22. In contrast to this, a lid 23 is of substantially flat shape and has a step 25 at its outer periphery. A flange 26 is formed at the upper end of the step 25. The flange 26 of the lid 23 is sealed to the flange 24 of the container main body 21 to provide a container of this embodiment.

Figure 11:
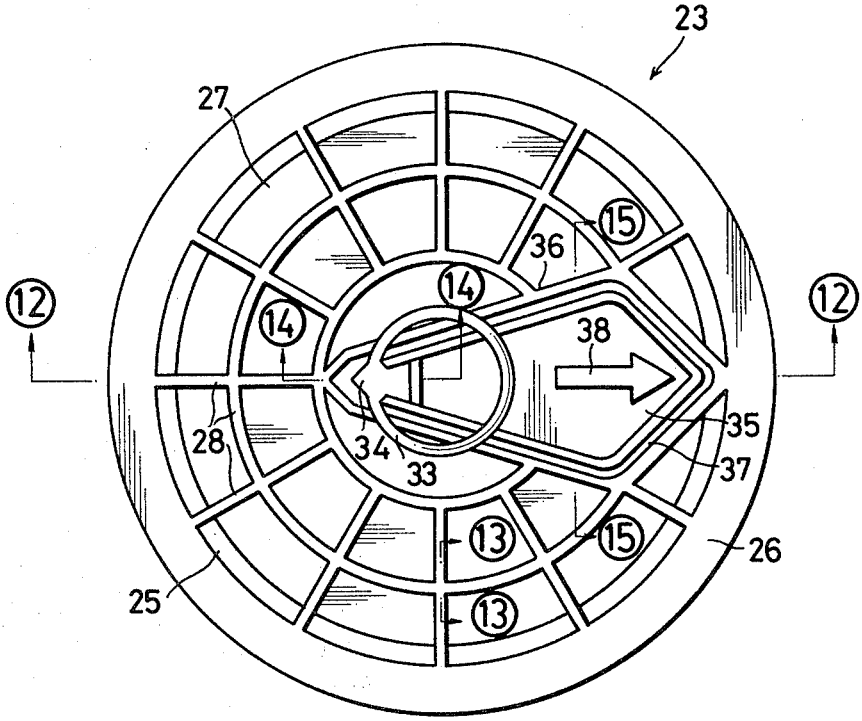
FIG. 11 is a plan view of the lid shown in FIG. 10.
Figure 12:
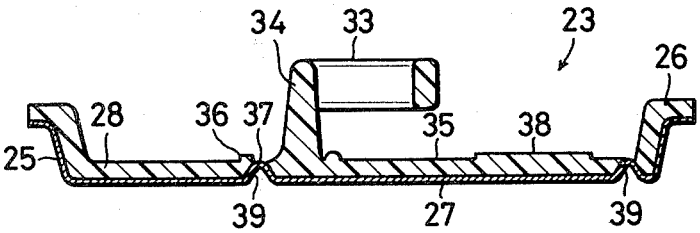
FIG. 12 is a sectional view along the line 12—12 in FIG. 11.
Figure 13:
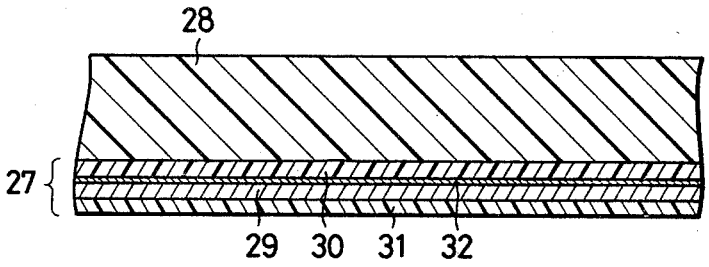
FIG. 13 is an enlarged sectional view along the line 13—13 in FIG. 11.

Referring to FIGS. 11 and 12, the lid 23 comprises a sheet-shaped base material 27; a rib structure 28 of a resin such as polyethylene formed on the outer surface of the base material 27 by injection molding; and so on. The sheet-shaped base material 27 comprises a laminate consisting of an aluminum foil layer 29 and resin layers 30 and 31 which are respectively formed on the upper and lower surfaces of the aluminum foil layer 29 and which are of the same material as the rib structure 28. An aluminum foil adhesion layer 32 is interposed between the resin layer 30 and the aluminum foil layer 29. The resin layer 30 is formed to improve adhesion with the base material 27 when the rib structure 28 is formed over the upper surface of the base material 27 by injection molding. On the other hand, the resin layer 31 melts and seals between the lid 23 and the container main body 21 during heat sealing.

Figure 14:
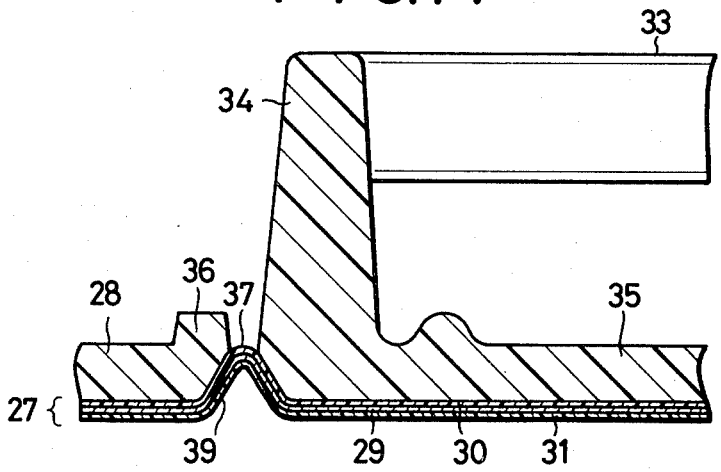
FIG. 14 is an enlarged sectional view along the line 14—14 in FIG. 11.
Figure 15:
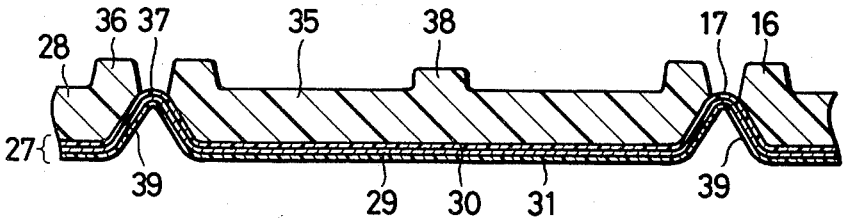
FIG. 15 is a sectional view along the line 15—15 in FIG. 14.

A ring-shaped pull-tab 33 is formed together with the rib structure 28 on the upper surface of the lid 23. The pull-tab 33 is connected through a connecting portion 34 to an island portion 35 formed on the base material 27. A protective rib 36 is formed on the upper surface of the base material 27 to surround the island portion 35. This protective rib 36 serves to protect lips from injury and projects above the rib structure 28. A slit-shaped cutting guide 37 defined by the absence of any resin body is thus formed between the protective rib 36 and the island portion 35 (FIGS. 14 and 15). Instead of removing the resin body, the resin body may be made thin in thickness to form the cutting guide. The cutting guide 37 is formed in a continuous manner to surround the island portion 35. When the island portion 35 is pulled by the pull-tab 33 through the connecting portion 34, the base material 27 is cut along the cutting guide 37 and the lid 23 is opened. An arrow 38 to indicate the direction in which to pull the pull-tab 33 is formed on the island portion 35 by molding.

In the lid 23 of this embodiment, a groove 39 is formed in the base material 27 in correspondence with the cutting guide 37 so that the base material 27 may be easily cut along the cutting guide 37. This groove 39 is formed by bending the base material 27 to project upward, as shown in FIGS. 14 and 15. More specifically, the groove 39 is formed by bending the base material 27 along the injection molding mold by the injecting pressure of the resin when the resin bodies, the rib structure 28, the rib 36, the pull-tab 33, and the island portion 35 are formed on the base material 27. Therefore, the groove 39 can be formed easily and without requiring extra steps by simply forming a projection in the injection mold corresponding to the groove 39 to be formed. When the lid 23 is opened, the groove 39 facilitates the initial opening of the lid 23. The step 25 around the lid 23 is formed by drawing the base material in the injection mold in a similar manner as in the case of the groove 39.

The lid 23 of the configuration as described above covers the opening 22 of the container main body 21 holding, for example, a soft drink. The flange 26 of the lid 23 and the flange 24 of the container main body 21 are bonded by heat sealing or the like. During this heat sealing, the resin layer 31 exposed to the lower surface of the base material 27 melts and is bonded to the flange 24.

In order to drink the soft drink held in the container main body 21, the lid 23 is opened by pulling the pull-tab 33. In the lid 23, the resin bodies such as the rib structure 28, the rib 36, the pull-tab 33, and the island portion 35 are formed on the outer surface of the base material 27. These resin bodies are made of polyethylene which is the same material as that of the resin layer 30 exposed to the upper surface of the base material 27. Therefore, these resin bodies are strongly bonded to the base material 27 and may not be easily separated from the base material 27. Even when the pull-tab 33 is pulled, the pull-tab 33 and the island portion 35 may not be separated from the base material 27.

Figure 16:
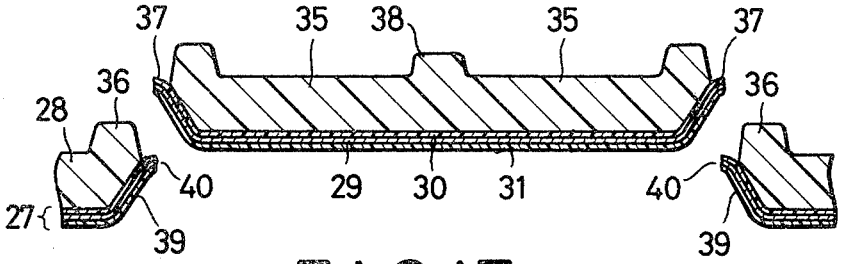
FIG. 16 is a sectional view similar to FIG. 15 according but in the open state.

When the pull-tab 33 is pulled upward, the pulling force is transmitted to the island portion 35 through the connecting portion 34. Then, the island portion 35 and the underlying base material 27 are separated from the remaining portions of the lid 23, as shown in FIG. 16, thus opening the container. Opening the container is accomplished by cutting the base material 27 along the cutting guide 37 formed between the rib 28 and the island portion 35. The groove 39 formed in the base material 27 facilitates cutting of the base material 27 along the cutting guide 37.

In this manner, the pull-tab 33 is pulled to cut the lid 23 along the cutting guide 37 and to form an opening 40 (FIG. 16). The user can then drink the soft drink held in the container main body 21 through this opening 40. Since the protective rib 36 is formed at the outer periphery of the opening 40, the lips can not be brought into contact with the cut edge of the base material 27 (including the aluminum foil layer 29) when the lips are brought close to the opening 40. Thus, the lips may not be cut by the aluminum foil layer 29. Since the resin layers 30 and 31 are formed on the upper and lower surfaces of the aluminum foil 29, these resin layers 30 and 31 also serve to protect the lips from the cut edge of the base material 27. Thus, injury to the lips may be prevented and the lid 23 can be rendered safe.

In the lid 23 of the embodiment described above, the resin bodies are formed only on the upper surface of the base material 27 which includes the aluminum foil layer 29; a small hole or notch need not be formed in the base material 27. For this reason, the aluminum foil layer 29 guarantees excellent gas barrier properties. Furthermore, the resin may not flow between the upper and lower surfaces of the base material 27. Since the aluminum foil layer 29 is reinforced by the resin layers 30 and 31 sandwiching it and the base material 27 is reinforced by the rib 28, the aluminum foil layer 29 may be thin. For example, an aluminum foil layer having a thickness of 40 μm or less may be used, without causing formation of pinholes. Furthermore, since the aluminum foil layer 29 is reinforced by the resin layers 30 and 31, the periphery of the base material 27 need not be curled.

Figure 17:
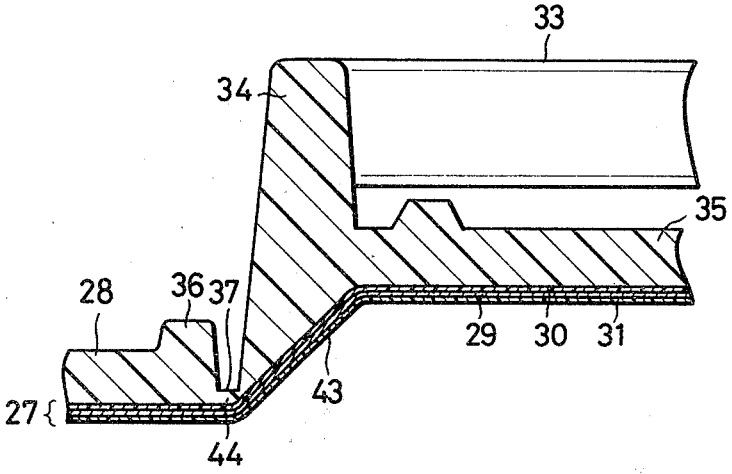
FIG. 17 is a sectional view similar to FIG. 14 according to still another modification.

A modification of the embodiment described above will now be described with reference to FIG. 17. In this modification, a step 43 is formed in place of the groove 39 in the base material 27 at the position corresponding to the cutting guide 37. This step 43 is formed with the injection mold used for molding the resin bodies or the rib structure 28, the rib 36, the pull-tab 33, and the island portion 35. In addition to the step 43, a resin layer 44 is formed on the surface part of the base material 27 corresponding to the cutting guide 37. This resin layer 44 is formed integrally with the rib structure 28, the rib 36, the pull-tab 33 and the island portion 35, but is formed thin to facilitate easy cutting. Thus, similar effects may be obtained with this modification.

Figure 18:
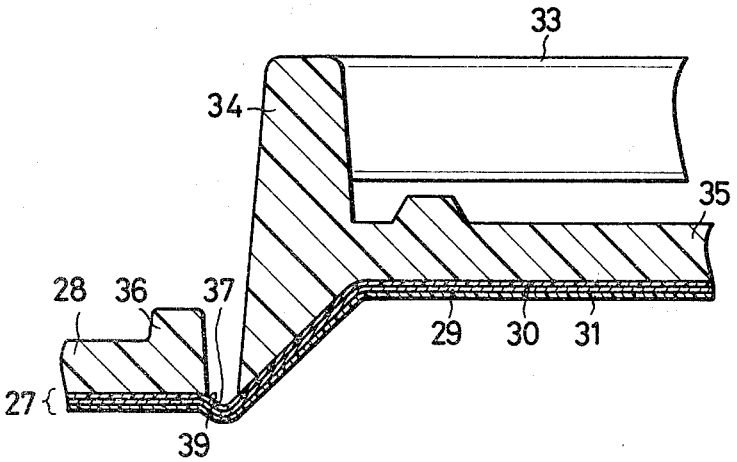
FIG. 18 is a sectional view similar to FIG. 14 according to still another modification.

FIG. 18 shows another modification of the above embodiment. In this modification, the groove 39 corresponding to the cutting guide 37 of the base material 27 faces upwards, unlike the embodiment described above. In order to form such a groove, the shape of the injection mold need only be reversed from that used in the above embodiment. This modification is thus easy to put into effect.

Figure 19:
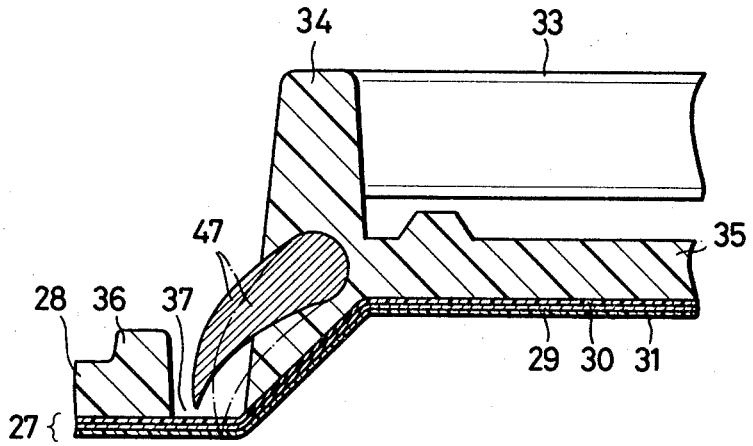
FIG. 19 is a sectional view similar to FIG. 14 according to still another modification.

FIG. 19 shows another modification of the above embodiment. In this modification, a blade 47 of metal with a sharp distal end edge is embedded in the connecting portion 34. When the pull-tab 33 is pulled upward, the distal end of the blade 47 lowers to cut the base material 27, as shown by the broken line in FIG. 19. The cutting operation of the base material 27 for opening the lid 23 is smoothly performed. The lid 23 is then cut along the cutting guide 37 from the position cut by the blade 47.

Figure 20:
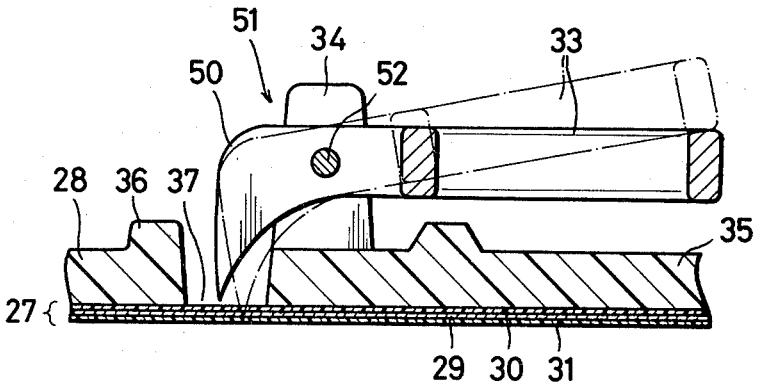
FIG. 20 is a sectional view similar to FIG. 14 according to a still another modification which is an improvement over that shown in FIG. 19.

FIG. 20 shows an improvement over the modification shown in FIG. 19. In this lid 23, a pull-up lever 51 is pivotally mounted through a pin 52 on the connecting portion 34. The pull-up lever 51 comprises the pull-tab 33 and a metal blade 50. The lever 51 may be made of synthetic resin or metal. When the lever 51 is pulled upward, the metal blade 50 cuts the part of the base material 27 corresponding to the cutting guide 37, as shown by the broken line in FIG. 20. Therefore, the cutting operation may be smoothly initiated as in the case of the modification shown in FIG. 19.

Figure 21:
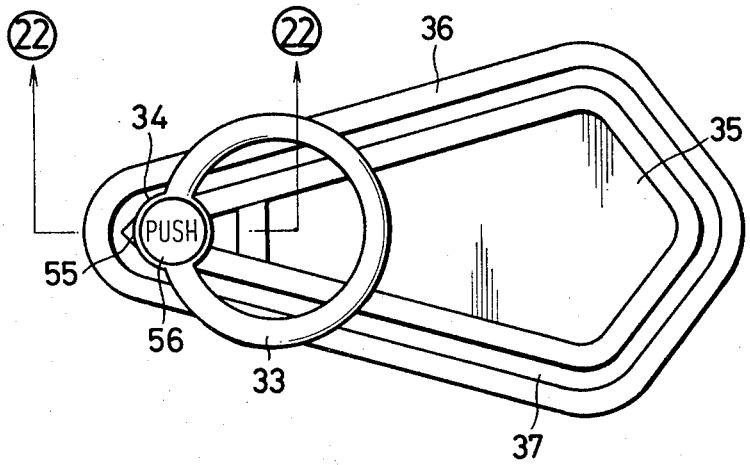
FIG. 21 is a partial plan view of a lid according to still another modification.
Figure 22:
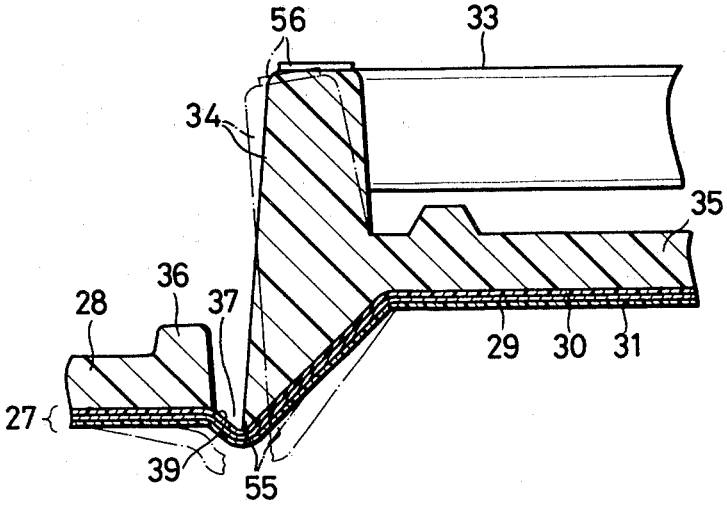
FIG. 22 is a sectional view along the line 22—22 in FIG. 21.

FIGS. 21 and 22 show further modifications. In these modifications, a projection 55 with a sharp distal end edge is formed at the lower part of the connecting portion 34. The projection 55 extends into the groove 39 formed in the base material 27 to face upward. When the upper end of the connecting portion 34 is depressed downward, the projection 55 starts cutting the base material 27 from the position of the cutting guide 37, as shown by the broken line in FIG. 22. This facilitates initiating the cutting operation of the base material 27. When the base material 27 is cut by the projection 55, the pull-tab 33 is then pulled upward to open the lid 23. Since the upper end of the connecting portion 34 must first be pushed in this case, a display 56 "PUSH" is conveniently attached on the surface of the connecting portion 34.

According to the modifications shown in FIGS. 11 to 22, when the pull-tab is pulled upward, the lid is opened at a determined position through the cutting guide which is defined by a thin resin body or by the absence of any resin body. The protective rib of the same resin material formed along the periphery of the cutting portion protects the lips from injury. Therefore, a safe lid is provided and injury by the metal foil of the base material may be prevented. Since the resin bodies are formed on the upper surface of the base material including the metal foil, the small hole or notch need not be formed in the base material, so that the gas barrier properties of the container may be improved.

Although the present invention has been described with reference to the particular embodiments, the present invention is not limited to this and various other changes and modifications may be made within the spirit and scope of the present invention. The present invention is not limited to containers of the shapes shown in the accompanying drawings but may be similarly applied to containers of various other shapes. The present invention is also similarly applicable to containers holding contents other than food. The laminate structure of the lid is also not limited to those of the embodiments described above but may be modified in various ways.

What is claimed is:

1. A container for holding an article, comprising:

(a) a container main body;

(b) a lid covering an opening of said container main body, said lid having a laminate structure of at least two kinds of materials, a first material being exposed upon an outer surface of said lid, and a second material being exposed upon an inner surface of said lid; and (c) cutting means for cutting at least part of said lid so as to form a cutting region, said cutting means comprising a pull-tab arranged on the outer surface of said lid, a cutting guide arranged on the inner surface of said lid along at least an outer periphery of said cutting region, and a connecting portion extending through a small hole formed in said lid so as to connect said pull-tab with said cutting guide, and said cutting means comprising molded bodies of a synthetic resin which can not be bonded to said first material and which can be bonded to said second material upon molding process thereof on said lid.

2. A container according to claim 1, wherein said container main body comprises a laminate structure of sheets or films of synthetic resins, paper, aluminum foil or a combination thereof.

3. A container according to claim 1, wherein said lid comprises a laminate structure of an aluminum foil layer as said first material and a synthetic resin film as said second material.

4. A container according to claim 3, wherein a coating is formed on a surface of said aluminum foil film.

5. A container according to claim 1, wherein said cutting region comprises a first region of a small area extending from substantially the center of said lid, and a second region of substantially the entire area of said lid surrounding said first region; and said cutting guide comprises a rib bonded to the inner surface of said lid, said rib surrounding an outer periphery of said first region and extending along an outer periphery of said second region.

6. A container according to claim 5, wherein said pull-tab is connected through said connecting portion to an end of said first region at substantially the center of said lid.

7. A container according to claim 1, wherein said pull-tab is of a ring shape.

8. A container according to claim 1, wherein said cutting means comprises a molded body of polyethylene terephthalate.

9. A container according to claim 1, wherein said container main body and said lid are sealed by heat sealing to complete said container.

* * * * *